US006412994B1

(12) United States Patent
Collard

(10) Patent No.: US 6,412,994 B1
(45) Date of Patent: Jul. 2, 2002

(54) METHOD OF AND APPARATUS FOR SELECTIVELY DEPOSITING PRINTED SHEETS ON SUPERIMPOSED SUPPORTS

(75) Inventor: René F. A. Collard, Gennep (NL)

(73) Assignee: Oce Technologies B.V., Venlo (NL)

( * ) Notice: Subject to any disclaimer, the term of this patent is extended or adjusted under 35 U.S.C. 154(b) by 0 days.

(21) Appl. No.: 09/648,110

(22) Filed: Aug. 25, 2000

(30) Foreign Application Priority Data

Aug. 27, 1999 (NL) ..... 1012924

(51) Int. Cl.[7] ..... B41J 7/02; B65H 39/10

(52) U.S. Cl. ..... 400/624; 101/232; 270/58.14; 271/293

(58) Field of Search ..... 400/624; 101/232; 270/58.14; 271/287, 293, 296, 297, 265.04, 288, 289

(56) References Cited

U.S. PATENT DOCUMENTS

| | | | | | |
|---|---|---|---|---|---|
| 4,349,190 | A | * | 9/1982 | Kaneko et al. | 271/297 |
| 4,782,363 | A | * | 11/1988 | Britt et al. | 271/287 |
| 5,106,076 | A | | 4/1992 | Fujita et al. | |
| 5,417,417 | A | * | 5/1995 | Takehara et al. | 271/296 |
| 5,449,167 | A | * | 9/1995 | Takehara | 271/296 |
| 5,535,012 | A | * | 7/1996 | Matsumoto et al. | 271/287 |
| 5,806,850 | A | * | 9/1998 | Yoneoka et al. | 271/296 |
| 6,227,539 | B1 | * | 5/2001 | Ferrara | 271/293 |
| 6,231,045 | B1 | * | 5/2001 | Yamada et al. | 270/58.14 |
| 6,247,695 | B1 | * | 6/2001 | Linder et al. | 271/265.04 |

FOREIGN PATENT DOCUMENTS

| | | |
|---|---|---|
| EP | 0532069 A1 | 3/1993 |
| EP | 0872777 A1 | 10/1998 |
| EP | 0888994 A | 1/1999 |
| NL | 1006471 | 7/1997 |

* cited by examiner

*Primary Examiner*—Eugene Eickholt
(74) *Attorney, Agent, or Firm*—Birch, Stewart, Kolasch & Birch, LLP

(57) ABSTRACT

A method and apparatus for selectively depositing printed sheets on four superimposed supports which are adjustable as to height independently of one another, each support being adapted to be placed, for the deposition of a sheet thereon, with its support surface or the top sheet situated on the support surface placed a short fixed distance beneath a fixed delivery point and printed sheets of a first type (A) are deposited on the bottom support and printed sheets of a second type (B) are deposited on the supports situated thereabove, wherein out of a group of sheets of a second type (B) for deposition, a first part is first deposited on a higher-level support and then a second part is deposited on a support therebeneath.

12 Claims, 8 Drawing Sheets

METHOD OF AND APPARATUS FOR SELECTIVELY DEPOSITING PRINTED SHEETS ON SUPERIMPOSED SUPPORTS

BACKGROUND OF THE INVENTION

The present invention relates to a method of selectively depositing printed sheets fed from a fixed delivery point onto at least three superimposed supports of a group of supports which are adjustable as to height independently of one another. Each support is adapted to be placed, for the deposition of a sheet thereon, with its support surface or the top sheet situated on the support a short fixed distance beneath the delivery point. Printed sheets of a first type can be deposited on at least the bottom support of the group of supports and printed sheets of a second type can be deposited on supports situated above of the group of supports.

A method of this kind is described in Netherlands Patent Application 1006471 filed on Jul. 4, 1997. This patent application describes a printing apparatus in which printed sheets of the first type are formed by sheets printed after activation of the printing apparatus by operation of a button on the printing apparatus. When the operator who locally started the printing apparatus to finish his print job removes the relevant prints from the bottom support, after completion of the print job, the placing of supports thereabove into a deposition position is no longer obstructed by prints situated on the bottom support, and the printing apparatus can again be fully utilised to deposit prints of the second type on supports situated above the bottom support and is, of course, also completely available for depositing prints of the first type on the bottom support.

One consequence of this method is that it does not function efficiently if an operator leaves his finished prints on the bottom support and the bottom support is no longer available, even after removal of prints, for prints for which the printing apparatus has been remotely activated by an operator, for example from a workstation at a distance from the printing apparatus. This will be an obstacle, particularly if in a specific period prints are requested only from workstations at a distance from the printing apparatus, which prints are often not picked up directly after completion.

In this case, it is readily possible that the printing apparatus can no longer be activated when the deposition capacity of the supports situated above the bottom support has been completely utilized and the bottom support remains unused.

SUMMARY OF THE INVENTION

The object of the present invention is to provide a method and apparatus which eliminates the above disadvantages.

To this end, according to the present invention, out of a group of sheets of the second type for deposition, a first part is first deposited on a higher-level support and then a second part is deposited on a support therebeneath. As a result, even if prints are not removed from the associated support directly after completion of a print job, the average deposition capacity remains large, particularly because prints which might be lying on supports situated between the higher-level support and the bottom support do not obstruct the higher-level support being moved into the deposition position.

Preferably, the first part of the group of sheets of the second type contains more sheets than the second part of the group of sheets of the second type. Consequently, a relatively large number of sheets of the second type can be deposited without the interim removal of sheets, because in the initial period of deposition on the higher-level support there is a greater probability that still relatively few sheets are deposited on the bottom support so that the top support can come into a low deposition position to receive a large number of sheets.

In one advantageous embodiment, a portion of sheets for deposition of the first type which are to be distinguished are deposited on the support situated directly above the bottom support. Consequently, printed sheets of the first type printed as an intermediate print job during an interruption of a print job for printing sheets of the same type are deposited on a support especially reserved for this purpose so that they can be readily located.

In a further advantageous method according to the present invention, in a first deposition cycle sheets are deposited selectively on the bottom support and on the top support of the group until at least the number of sheets on the bottom support reaches a height "a" corresponding to one-half the distance between the delivery point and the lowest possible position of the bottom support. In following deposition cycles in each case, sheets are deposited selectively on the bottom support and, counting from the top, on the next free support of the group until at least the number of sheets on the bottom support reaches a height corresponding to the height "a" plus in each case one-half the height of the sheets deposited on the bottom support in the preceding deposition cycle.

One embodiment of a sheet deposition device for performing the method according to the present invention comprises drive means at each support for adjusting the same as to height, and also control means which, in an initialization cycle, on adjustment of the sheet deposition device to the deposition of sheets of the first type, activate the drive means for the supports in order to move the supports situated above the bottom support to a position above the delivery point and the bottom support into its deposition position, at least insofar as there is room for movement for this purpose. On adjustment of the sheet deposition device to the deposition of sheets of the second type, the drive means is activated for the supports to move the top support into its deposition position and the supports situated beneath the top support to directly therebeneath, again insofar as there is room for movement for such purpose. The control means, when a predetermined number of sheets has been delivered on the top support, moves said support to above the delivery point and the support directly therebeneath into its deposition position.

The effect of this embodiment is that on each initialization of this sheet deposition device according to the invention a check is made whether on deposition of sheets of the second type there is still deposition space available on the top support, or such space has been freed by removal, so that in that case deposition on the top support takes place first before proceeding to deposition on the support situated directly therebeneath. This ensures that the deposition space for sheets of the second type is used in an optimum manner.

In a further embodiment of a sheet deposition device according to the present invention, in which the drive means can move a support up and down between the deposition position in which sheets can be deposited on said support and a parking position in which sheet deposition is not possible, each support is provided with detection means for detecting an obstacle in the space directly therebeneath, for example sheets on a support situated directly therebeneath, which detection means delivers a first detection signal when the distance between the support provided with said detection means and an obstacle directly therebeneath is greater than a predetermined amount in order to make the drive means capable of activation.

The effect of this is that the free space between the supports can be restricted to a minimum in order to obtain maximum deposition capacity.

BRIEF DESCRIPTION OF THE DRAWINGS

Other features and advantages of the invention will be explained hereinafter with reference to the accompanying drawings wherein.

DETAILED DESCRIPTION OF THE INVENTION

Figure 1:
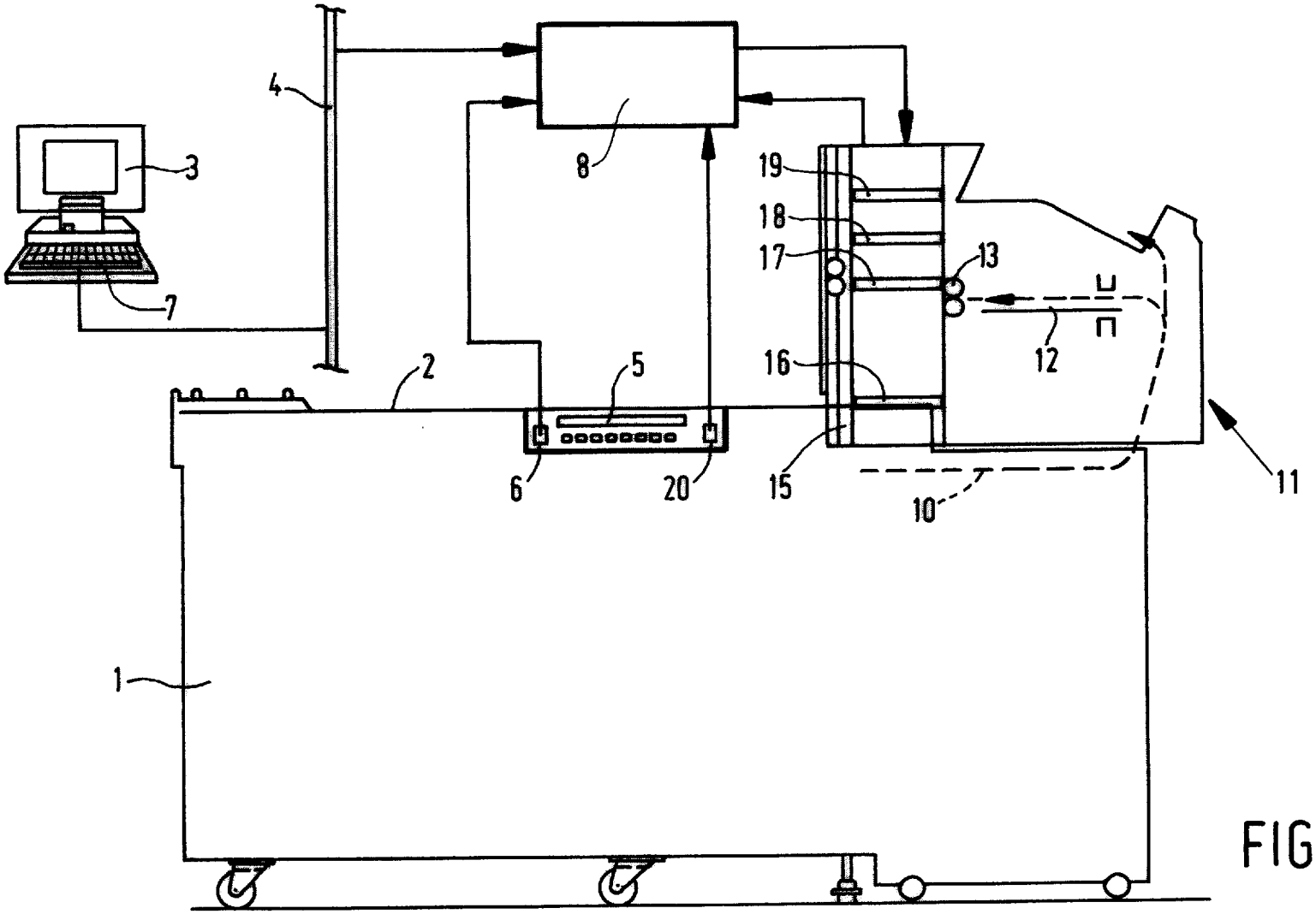
FIG. 1 illustrates one embodiment of a printing apparatus according to the present invention.
Figure 2:
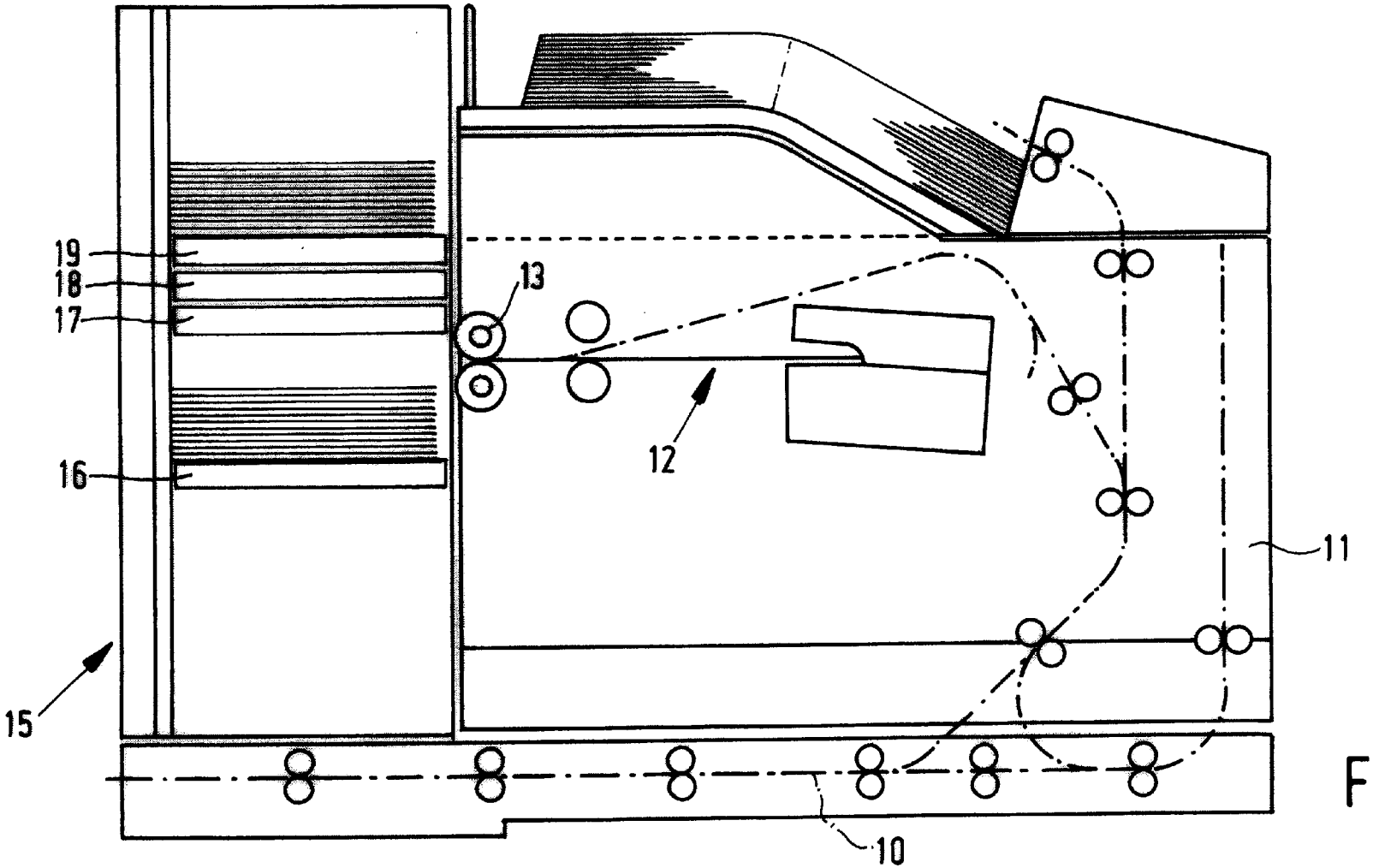
FIG. 2 shows a part of the printing apparatus shown in FIG. 1 in a position in which sheets are deposited on the bottom support.
Figure 3:
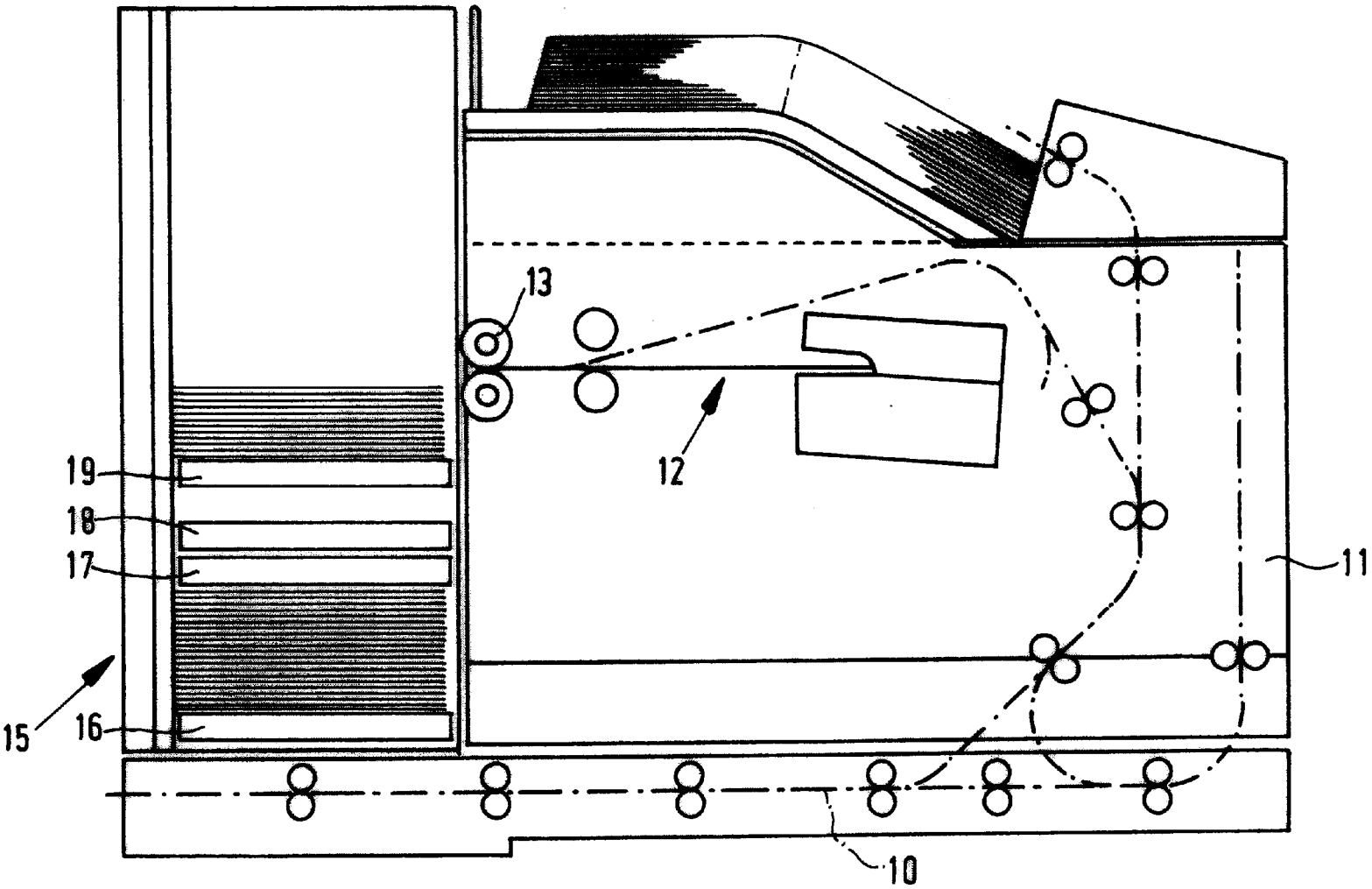
FIG. 3 shows the part of the printing apparatus according to FIG. 2 in a position in which sheets are deposited on the top support.
Figure 4:
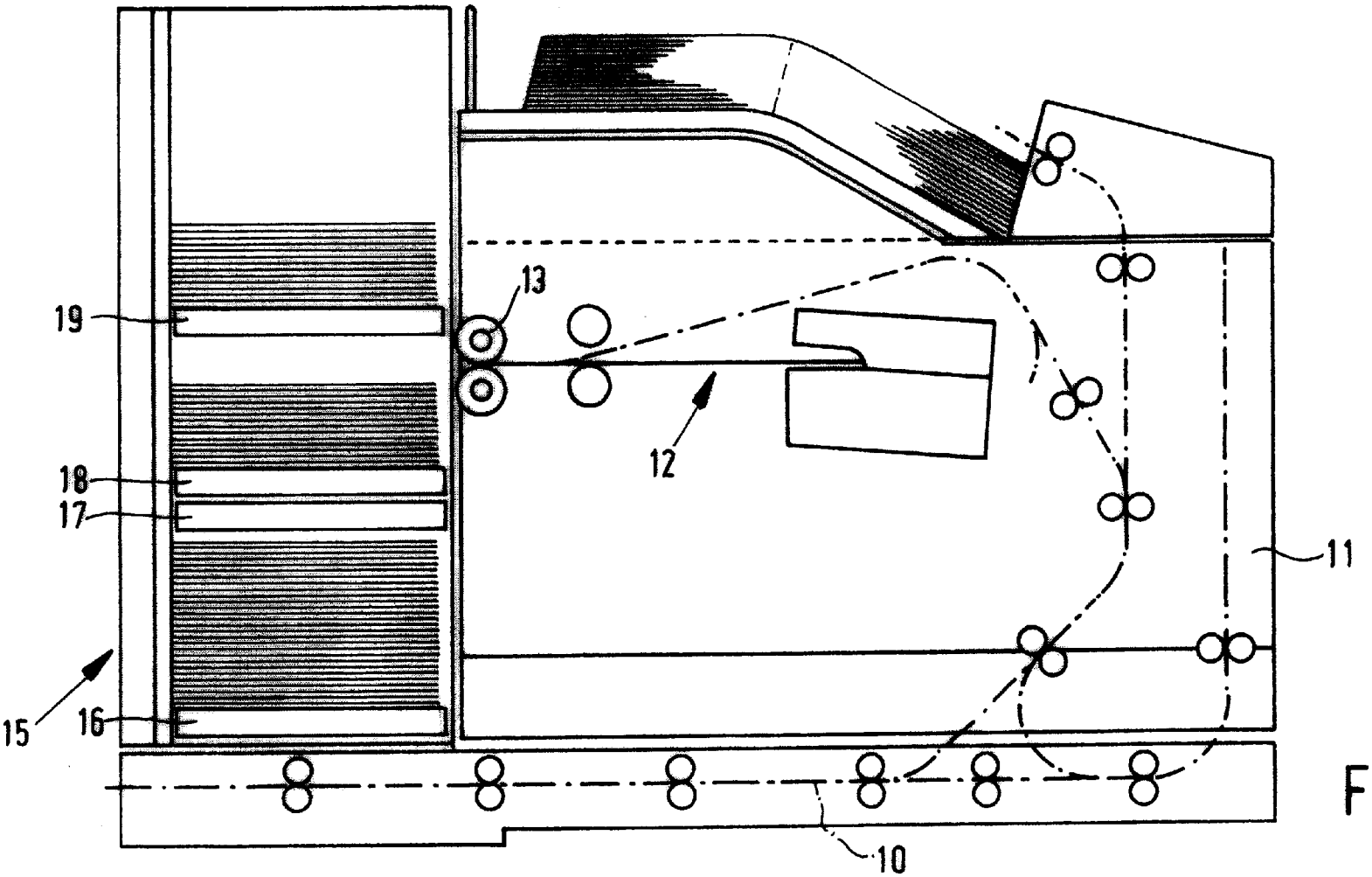
FIG. 4 shows the part of the printing apparatus of FIG. 2 in a position in which sheets are deposited on the support situated directly beneath the top support.
Figure 5:
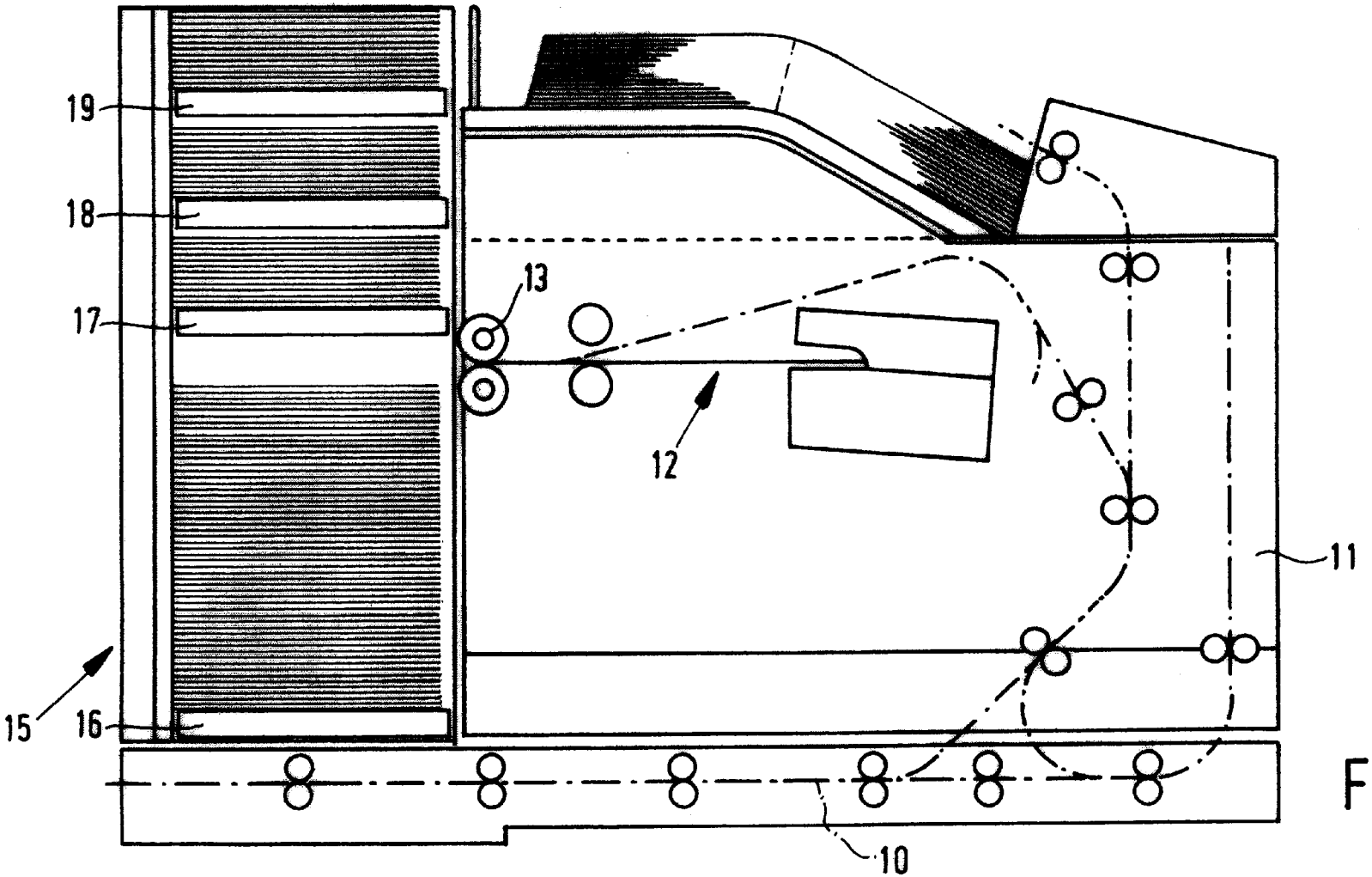
FIG. 5 shows the part of the printing apparatus of FIG. 2 in which sheets are deposited on the bottom support without sheets having been removed from the supports thereabove.

The printing apparatus 1 shown in FIG. 1 comprises means known per se for printing an image on a receiving sheet. These images for printing may be present on original documents which are fed to a scanning station 2 situated at the top of the printing apparatus 1. Images for printing can also be fed in digital form from a workstation 3 connected via a network 4 to a control device 8 of the printing apparatus 1. A printing cycle for copying an original set fed via the scanning station 2 is started by actuating a start button 6 on the operator control panel 5 of the printing apparatus 1.

A printing cycle for printing an image set fed via workstation 3 can be started by actuating a start button 7 provided on the workstation 3, via control device 8 (hereinafter referred to as automatic printing), or by actuating a start button 6 provided on the operator control panel 5 of the printing apparatus 1 (hereinafter referred to as semiautomatic printing).

In the printing apparatus 1 shown in FIG. 1, the sheet transport path 10 forms the path for delivering to a sheet finishing station 11 the sheets printed in the printing apparatus.

The finishing station 11 contains a sheet collecting tray 12 (not shown in detail) in which a number of printed sheets belonging to a set can be collected and stapled, whereafter discharge roller pairs 13 feed the set to a sheet deposition unit 15 forming part of a sheet finishing station 11.

The sheet deposition unit 15 comprises four superimposed deposition tables 16, 17, 18 and 19, each of which can be set to a deposition position with respect to the horizontal discharge path formed by the discharge roller pair 13, to receive sheets discharged by the discharge roller pair 13. The vertical displacement of the deposition tables can be effected by means of the displacement mechanism described in European Patent Specification 0 532 069, the selected deposition table or the sheet at the top thereof always lying just beneath the discharge path formed by the discharge roller pair 13.

FIG. 1 shows the bottom deposition table 16 in a bottom deposition position in which a number of sheets are situated on the deposition table 16, and the deposition tables 17, 18 and 19 situated in parking positions above the discharge path formed by the discharge roller pair 13.

Since the deposition tables 17, 18 and 19 are adjustable as to height, independent of deposition table 16, the top deposition table 19 can be placed in a deposition position without the bottom deposition table 16 needing to be moved further down from the bottom position shown in FIG. 1.

As a result, the finishing station 11 with the sheet deposition unit 15 disposed adjacent thereto is very suitable for positioning at the top of a printing apparatus 1. The scanning station 2 is situated at a normal working height for a standing operator, e.g., about 100 cm from the floor. In the printing apparatus 1 with the finishing station 11 as shown in FIG. 1, the removal height for sheets deposited on deposition tables 16, 17, 18 and 19 is between 100 cm and 160 cm for a total sheet deposition capacity of about 3000 sheets. The sheet deposition level defined by the fixed discharge rollers 13 is approximately 133 cm, and this level corresponds to the deposition level where the bottom deposition table 16 is in its bottom deposition position.

The combination of high deposition capacity and limited overall height is rendered possible by using the printing apparatus according to the present invention, namely by using the bottom deposition table 16 solely for the deposition of prints of a first type, the printing cycle of which being initiated with a setting button on the printing apparatus. The operator who makes this setting can also remove the deposited prints shortly thereafter, giving the deposition tables situated thereabove the opportunity to come into their deposition position and receive prints of a second type. The printing cycle is initiated from a workstation 3 at a distance from the printing apparatus.

The operation of the printing apparatus according to the present invention will now be explained further with reference to FIGS. 2 to 5, which show, in greater detail and in different positions, the finishing station 11 shown in FIG. 1.

FIGS. 6A to 6I show an ideal model of a sheet deposition system limited in height by a floor 30 and a ceiling 31 which consists of a plurality of deposition plates 32, 33, 34, 35, 36 and so on, which are adjustable as to height independently of one another. The sheet delivery point 37 is situated approximately half way between the floor 30 and the ceiling 31, as shown in FIG. 6A. The model is also based on a situation in which there are two types of sheets A and B which are delivered successively and which have to be deposited separately from one another.

When a sheet of type A is delivered, only plate 32 moves to beneath the delivery point 37 (FIG. 6B) and when a sheet of type B is delivered then all the plates 32, 33, 35, 36 . . . move to below the delivery point for deposition on the top plate (36 in this case) until sheets A and B completely fill the space between delivery point 37 and floor 30 (FIG. 6C). Plate 36 is then moved away completely above the delivery point (FIG. 6D). Further sheets for deposition are now deposited alternately on the bottom plate 32 and the top plate but one (35 in this case) until the number of sheets on plate 35 amounts to half the number of sheets on plate 36. This situation is shown in FIG. 6E.

Plate 35 is then moved away completely above the delivery point 36 (FIG. 6F) and the deposition process continues with tables 32 and 34 until table 34 accommodates half the number of sheets lying on table 35. The same procedure takes place with tables 32 and 33 until the situation shown in FIG. 61 is finally reached.

Given an infinite number of extremely thin plates, the situation can be achieved such that the entire space between the floor 30 and the ceiling 35 is substantially filled with sheets. In view of the necessary thickness of the plates, the additional deposition capacity attainable with an additional deposition plate is practically nil. Normally, therefore, there is little logic in increasing the number of deposition plates to more than approximately 5–6 plates, because the available extra deposition capacity is no longer compensated by the cost of the extra deposition plate required.

Figure 6:
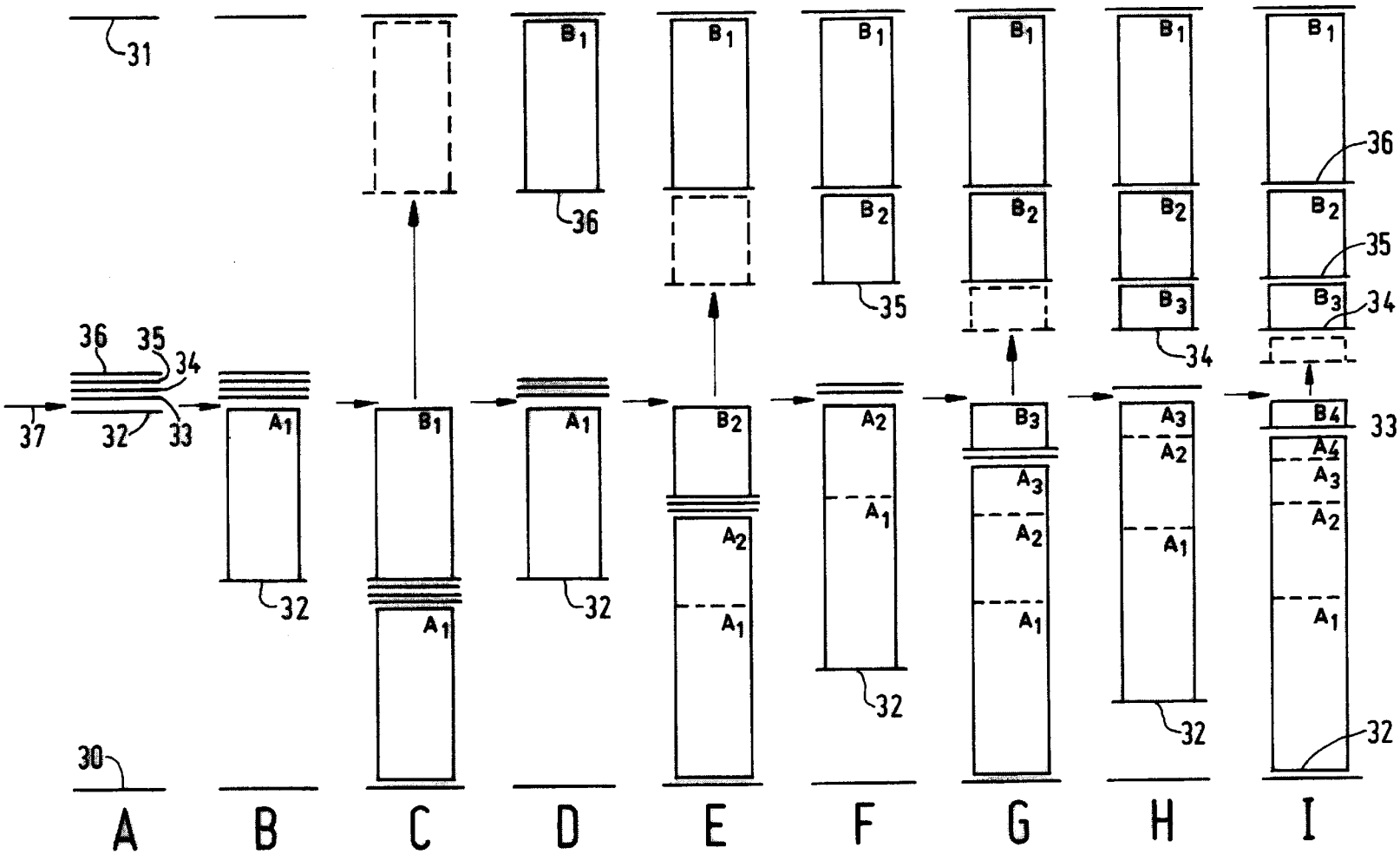
FIGS. 6A to I illustrates an ideal model of a sheet deposition system according to the present invention.

If the sheets of types A and B are not deposited alternately, and instead all the sheets of type B first and then all the sheets of type A next, the same deposition capacity is obtained as shown in FIG. 6.

However, if sheets of type A are first to be deposited up to the maximum deposition capacity of plate 32 and only then sheets of type B, then there is no longer any room for the latter.

Since the distribution of the delivery of sheets of types A and B is usually not preset, the available deposition capacity will vary between the number of sheets corresponding to the distance between the floor 30 and delivery point 37 and the floor 30 and ceiling 31.

Since the deposition space freed, as the last occurs when the bottom deposition table but one is moved aside to above the delivery point, a maximum deposition capacity can be achieved with a limited number of deposition tables if the number of sheets of type A is deposited as the last on the bottom support. In the case of a printing apparatus which normally prints sheets of types A and B in a specific alternation, this can be achieved by storing in a memory a number of images A which are to be printed as the last, said number corresponding to the number of sheets of type B deposited on the bottom table but one, and by not printing the stored images A until the said number has been deposited on the bottom table but one.

FIGS. 7A to 7H show a method performed with the embodiment of the printing apparatus according to the present invention as shown in FIG. 1, wherein up to a maximum of 2250 sheets of a first type A can be deposited on the bottom support 16 and up to a maximum of 500 sheets of a second type B can be deposited on each of the supports 17, 18 and 19 (hence in all 3750 sheets as shown in FIG. 7A), without it being necessary to interrupt the printing process to remove sheets from the supports.

Starting from a situation in which the sheet deposition device is empty, a total of 1250 sheets is first deposited on supports 16 and 19, for example 750 sheets on support 16 and 500 sheets on support 19, as shown in FIGS. 7B and 7C. Support 19 is then raised to a parking position and then 1000 following sheets are deposited on supports 16 and 18, e.g. 500 sheets on support 16 and 500 sheets on support 18, as shown in FIGS. 7D and 7E.

Support 18 is then also raised to a parking position and the following 750 sheets are deposited on support 16 and 17, for example 500 sheets on support 16 and 250 sheets on supports 16 as shown in FIGS. 7F and 7G.

Finally, support 17 is also raised to a parking position and a number of sheets can then be deposited in the space that has been freed on support 16, for example 750 sheets of type A on support 16 as shown in FIG. 7H.

Figure 7:
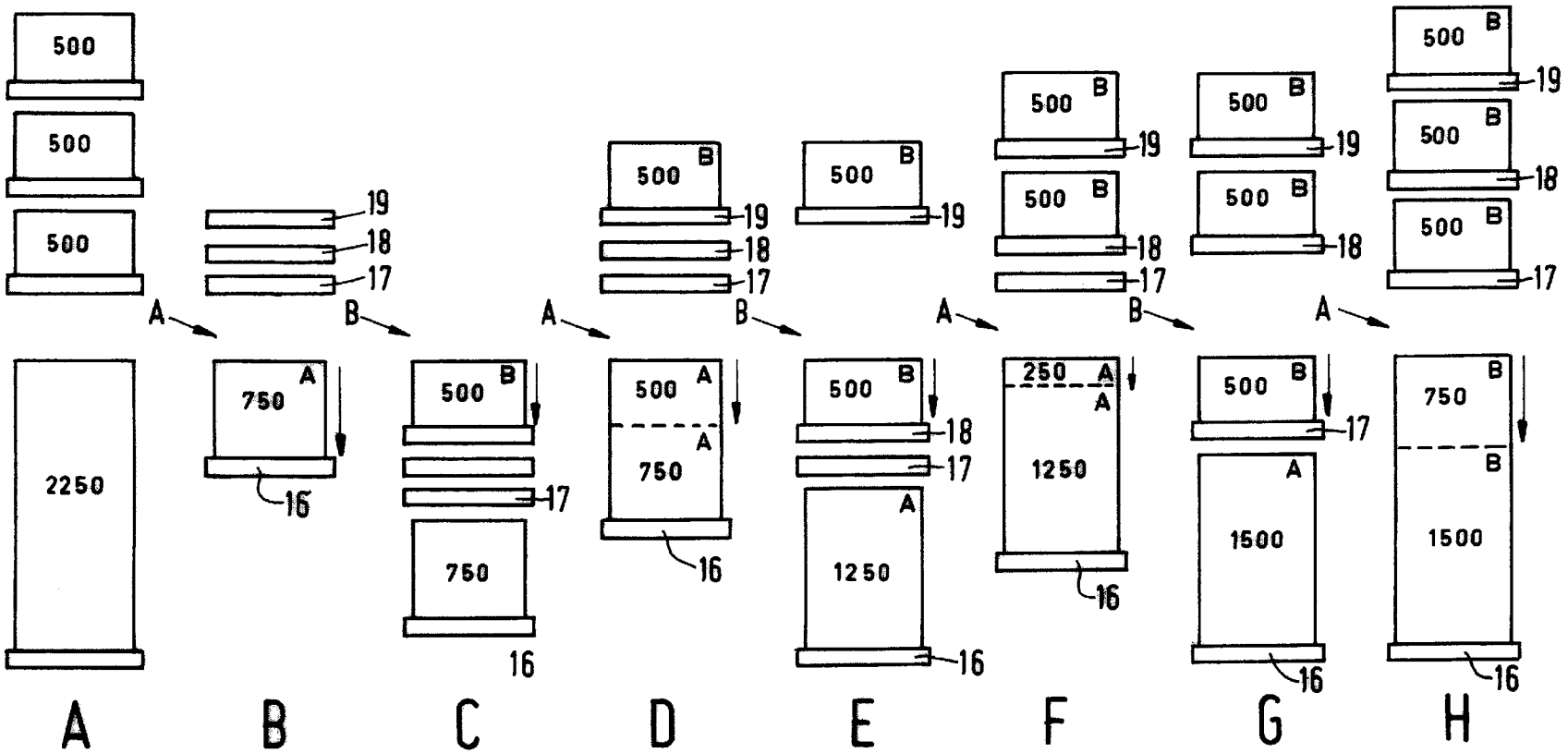
FIGS. 7A to H shows a practical embodiment of the method according to the model shown in FIG. 6

A requirement for a method in which the supports 17, 18 and 19 situated above the bottom support 16 can come into a parking position above the sheet delivery point is that the total number of sheets deposited on these supports 17, 18 and 19 in an uninterrupted printing process remains limited, for example, to 1500 sheets in the embodiment shown in FIG. 7. The available deposition capacities when solely sheets of type A are supplied is 2250 sheets, while when only sheets of type B are supplied it is 1500 sheets and in the case of a mix of sheets of types A and B the deposition capacity is often very much above 2250 sheets with a maximum of 3750 sheets.

If, in the case of a mixed delivery, a total of more than 750 sheets of type A takes place before 500 sheets of type B have been deposited on support 19, the deposition capacity for sheets of type B is limited to the number of sheets actually deposited on support 16 minus 750.

A corresponding further capacity limitation can be obtained if delivery of a total of more than 1250 sheets of type A takes place before 500 sheets of type B have been deposited on support 18 and also if delivery of a total of 1500 sheets of type A takes place before 500 sheets of type B have been deposited on support 17. In all these cases, the supports 19, 18 and 17 can no longer come into a deposition position to receive 500 sheets on each of said supports.

All the supports can be provided, at their underside, with detectors which respond to an obstacle therebeneath, e.g. to the top of a stack of sheets situated directly thereunder.

A control system is on the one hand connected to each of these sensors and to the drive system for the height adjustment of each of the supports. When sheets are removed from a support in a parking position, the distance between the remaining sheets and a support situated directly thereabove increases and the detector beneath said support comes out of the range of the remaining sheets and consequently extra deposition space becomes available. This space can be increased by moving the support situated beneath the delivery point further downwards until the detector beneath said support again responds to an obstacle therebeneath in the form of a stack of sheets or by moving further upwards a support situated above the delivery point until the detector beneath the support thereabove again responds to an obstacle therebeneath, for example a remaining stack of sheets.

A detector can also be disposed at a fixed position above the top support to detect a (remaining) stack of sheets on the top support in order that the top support can also be moved further upwards on removal of sheets, again to utilise the deposition space that has been freed.

In a practical application of the method described hereinbefore ("walk up priority printing"), type A is formed by sheets printed on activation of the printing apparatus by an operator at the printing apparatus (interactive print jobs) and type B is formed by sheets printed on activation of the printing apparatus by a user at a workstation at a distance from the printing apparatus (automatic print jobs).

In addition to "walk up priority" printing, print jobs can also be sorted with respect to other criteria, for example:

jobs from a first group of users on the bottom support or supports and jobs from a second group of users on the top support or supports; and jobs with stapled sheet sets on the top support or supports, for example a maximum of 500 stapled sheets on each of the two top supports and jobs with non-stapled sheet sets on the bottom support or supports, for example 2250 sheets and 500 non-stapled sheets, respectively, on the two bottom supports.

Instead of two deposition classes as always described hereinbefore, the top-down algorithm can also be applied to deposition on the top supports for three or more deposition classes, for example three deposition classes in the case of four supports, top-down deposition being used for one class on the top two supports.

Furthermore, one support can remain unused in the case of sorting of print jobs over two deposition classes, for example, the second support from the bottom in order to reserve it and mark it for intermediate jobs. The advantage of this procedure is that it is clear to a user having an intermediate job where the user can remove his intermediate job and there is no need for him to look between the jobs deposited on the other supports.

The above-mentioned top-down algorithm is also usable for one deposition class, in which when the supports are filled from the top to the bottom, the attempt is again made to provide top-down deposition for subsequent jobs for deposition, use being made of the space freed by printed sheets being removed from the supports. A condition for this is that it is possible to detect that sheets have been removed from supports.

Figure 8:
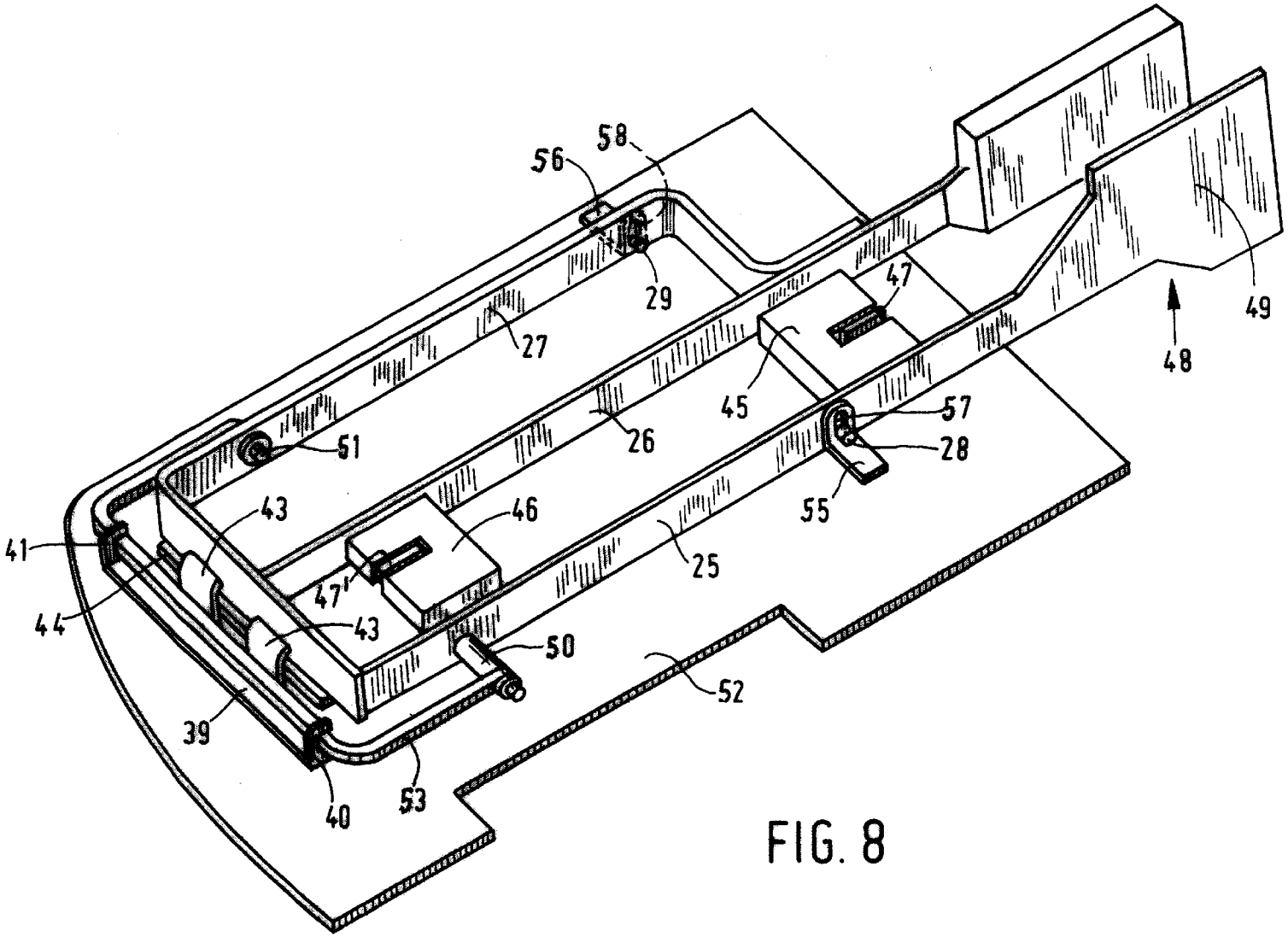
FIG. 8 shows the detection means mounted beneath each support.

For detection suitable for the purpose beneath the supports for sheet stacks, each deposition table 16, 17, 18 and 19 is provided with two straps 25, 26 shown in FIG. 8, at the top of which the deposition plate (not shown in FIG. 8) for sheets is secured.

A U-shaped strap 27 extends at one of the adjacent straps 25 and 26 and is secured to strap 26 and is situated in the same horizontal plane as the straps 25 and 26. Looking in the direction in which sheets are fed by the transport roller pair 13 on to the deposition plate, the straps 25 and 27 extend beneath the sides of the deposition plate and are rigidly connected thereto.

Pins 28 and 29; 50 and 51 respectively are fixed at the sides of the straps 25 and 27 extending away from one another. Looking in the sheet discharge direction, pins 28 and 29 are situated opposite one another at the upstream end of the straps 25 and 27. A flat switch plate 52 is situated beneath the straps 25, 26 and 27 and extends parallel to the deposition plate. Two brackets 55 and 56 are fixed on the switch plate 53.

Upright parts of the brackets 55 and 56 are provided with slots 57 and 58 extending vertically and accommodating pins 28 and 29 with clearance. A U-shaped hinge arm 53 is rotatably connected at its ends to pins 50 and 51 respectively. The hinge arm 53 extends around the straps 25, 26 and 27 and is in the same plane as the straps.

A U-shaped bent strip 39 is fixed on the switch plate 52. The upwardly extending limbs of the strip 39 are provided with indentations 40 and 41 in which the center piece of the hinge arm 53 fits. The switch plate 52 is also provided with a strip which at the top has bent-over edges 43 which, in the position of rest of the switch plate 52, rest on a projection 44 fixed on the strap 27. In the position of rest of the switch plate 52, the top edges of slots 57 and 58 rest on pins 28 and 29 respectively and the bent-over parts 43 rest on projection 44. In this position of rest the switch plate 52 is situated a short distance, e.g. a distance of 7 mm, beneath the straps 25, 26 and 27 and extends parallel to the deposition plate fixed on these straps.

When a deposition table moves down and the switch plate 52 meets an obstacle therebeneath (e.g. a sheet stack on a deposition table therebeneath), then on the further downward movement of the deposition table the switch plate 52 is pressed in the direction of the straps 25, 26 and 27 until the switch plate encounters the straps. This movement of the switch plate 52 is made possible by the slots 57 and 58 and by the turning of the hinge arm 53. The construction of the hinge arm 53 held in indentations 40 and 41 ensures that the switch plate 52 cannot in these conditions rotate about a line parallel to the sheet discharge direction. The switch plate 52 can only tip about a line extending transversely of the sheet discharge direction. When the switch plate 52 first comes into contact with an obstacle at the upstream side, then the switch plate 52 moves up only at that side in the two slots 57 and 58, even if the obstacle is situated only beneath one corner part on that side, and when the switch plate 52 first comes into contact with an obstacle on the downstream side, then the switch plate 52 moves up only on that side with the rotation of the hinge arm 53, even if the obstacle is situated only beneath one comer point on that side.

An opto-electrical switch 45 is disposed on the upstream side of each deposition table between the straps 25 and 26 and an opto-electrical switch 46 is disposed on the downstream side of each deposition table between the straps. Each of the switches 45 and 46 co-operates with a blade 47, 47' respectively fixed on the switch plate 52. During a movement of the switch plate 52 in the direction of a downwardly moving deposition table, blade 47 and/or blade 47' will activate the associated switch or switches 45, 46, in response to which the drive of the downward moving deposition table is interrupted.

The switching time is so chosen that switch plate 52 can thereafter still move further before it encounters the straps. During this last movement, which can take place when the opto-electrical switch refuses to operate, the blade actuates a microswitch (not shown) which, for protection purposes, breaks the drive to all the deposition tables. The protective microswitch does not normally respond. The above-described suspension of the switch plate ensures that activation of the switch plate can take place at each of the comer points, and yet only two switching elements are necessary instead of four. The switch plate 52 should be sufficiently torsion-resistant and is, therefore, constructed for example from 2 mm thick aluminium.

The use of the switch arm 53, situated around the straps between the deposition plate and the switch plate, ensures a flat construction which, for example, has a total overall height of only 20 mm with the required stroke length of 7 mm for the switch plate, of which, for example, 4 mm is for the opto-electrical switches and 3 mm for the protective microswitch.

At the drive side 48, where they are connected to a motor which can adjust the associated deposition table as to height, the straps 25 and 26 have an elevation 49 by means of which they can come into contact with the strap of a deposition table thereabove. This elevation is of a size such that two tables between which there are no sheets cannot come so close together that the protective microswitch can respond. Only when there are sheets or some other obstacle between the deposition tables can the microswitch respond and the switching off of the motors which move the deposition tables can be rendered inoperative by the removal of the sheets which caused the microswitch to respond.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of selectively depositing printed sheets fed from a fixed delivery point on a plurality of superimposed supports which are adjustable as to height independently of one another, each support being adapted to be placed, for the deposition of a sheet thereon, with its support surface or the top sheet situated on the support surface positioned a short fixed distance beneath the delivery point and printed sheets of a first type (A) are deposited on at least a bottom support of the plurality of supports and printed sheets of a second type (B) are deposited on supports situated thereabove of the plurality of supports, wherein out of the plurality of sheets of the second type (B) for deposition, a first part is first deposited on a higher-level support and then a second part is deposited on the support therebeneath.

2. The method according to claim 1, wherein the first part of the group of sheets of the second type (B) comprises more sheets than the second part of the group of sheets of the second type (B).

3. The method according to claim 1 wherein a portion of sheets for deposition of the first type (A) which are to be distinguished are deposited on the support situated directly above the bottom support.

4. The method according to claim 1 wherein a first deposition cycle sheets are deposited selectively on the bottom support and on the top support of the group until at least the number of sheets on the bottom support reaches a height corresponding to one-half the distance between the delivery point and the lowest possible position of the bottom support and that in subsequent deposition cycles in each case sheets are deposited selectively on the bottom support and, counting from the top, on the next free support of said plurality of supports until at least the number of sheets on the bottom support reaches a height corresponding to the height "a" plus, in each case, one-half the height of the sheets deposited on the bottom support in the preceding deposition cycle.

5. A sheet deposition device for selectively depositing printed sheets fed from a fixed delivery point on a plurality of superimposed supports which comprises:

drive means at each support for adjusting the same as to height, wherein control means are provided which, in an initialization cycle, on adjustment of the sheet deposition device to the deposition of sheets of a first type (A), activates the drive means for the supports in order to move the supports situated above a bottom support to a position above the delivery point and the bottom support into its deposition position, at least insofar as there is room for movement for this purpose, and, on adjustment of the sheet deposition device to the deposition of sheets of a second type (B), activates the drive means for the supports to move a top support into its deposition position and the supports situated beneath the top support to directly therebeneath, insofar as there is room for movement for this purpose, and the control means moves said support to above the delivery point and the support directly therebeneath into its deposition position when a predetermined number of sheets has been delivered to the top support.

6. The sheet deposition device according to claim 5, wherein the drive means can move the support up and down between a deposition position in which sheets can be deposited on said support and a parking position in which sheet deposition is not possible, wherein each support is provided with detection means for detecting an obstacle in the space directly therebeneath, said detection means delivering a first detection signal when the distance between the support provided with said detection means and the obstacle directly therebeneath is greater than a predetermined amount in order to make the drive means capable of activation.

7. The sheet deposition device according to claim 6, wherein first control means are provided which, in response to the reception of a first detection signal delivered by the detection means at a support which is in a deposition position, make the drive means of said support capable of activation to move said support down on deposition of subsequent sheets thereon.

8. The sheet deposition device according to claim 7, wherein second control means are provided which, in response to the reception of a first detection signal delivered by the detection means at a support in a parking position and lower than a support in a deposition position, activate the drive means of said support in order to move said support downwards.

9. The sheet deposition device according to claim 8, wherein third control means are provided which, in response to the reception of a first detection signal delivered by the detection means at a support situated above a support in a parking position directly above a support in a deposition position, activate the drive means at the support in a parking position directly above a support in the deposition position in order to raise the support directly above the support in the deposition position.

10. The sheet deposition device according to claim 9, wherein further detection means are fixed above the top support for detecting sheets on said top support and delivering a first detection signal when the distance between the fixed detection means and the top sheet on the top support is greater than a predetermined amount.

11. The sheet deposition device according to claim 10, wherein fourth control means are provided which, in response to the reception of a first detection signal delivered by the fixed detection means, activate the drive means at the top support to raise the top support.

12. The sheet deposition devices of claim 5, wherein the plurality of superimposed supports is four in number.

* * * * *